US006269986B1

(12) United States Patent
Gross

(10) Patent No.: US 6,269,986 B1
(45) Date of Patent: Aug. 7, 2001

(54) DISPENSING CLOSURE WITH TAMPER EVIDENT LID PANEL

(75) Inventor: Richard A. Gross, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/597,427

(22) Filed: Jun. 20, 2000

(51) Int. Cl.[7] ..... B65D 47/10

(52) U.S. Cl. ..... 222/541.5; 222/153.06; 220/257

(58) Field of Search ..... 222/153.06, 153.14, 222/541, 556, 23; 215/216, 211, 235, 237, 245; 220/257, 258

(56) References Cited

U.S. PATENT DOCUMENTS 5,662,245 * 9/1997 Grant ..... 222/153.14

* cited by examiner

*Primary Examiner*—Philippe Derakshani
*Assistant Examiner*—Thach H Bui
(74) *Attorney, Agent, or Firm*—Rockey. Milnamow & Katz, Ltd.

(57) ABSTRACT

A closure structure for a container includes a body having a containing wall for closing the container, the containing wall having a dispensing orifice. A lid is operatively associated with the containing wall to cover the dispensing orifice in a closed position and uncover the dispensing orifice when the lid is moved away from the closed position. In one embodiment, a tamper-indicating member includes a press portion connected by a hinge to the lid, and an anchor portion connected to the body, the press portion connected at a frangible junction to the anchor portion, whereby the press portion can be moved sufficiently relative to the body to separate the press portion from the anchor portion. The anchor portion is connected to the body by an anchor member extending radially from the body. The anchor portion includes an aperture. The body includes a radially extending head which captures the aperture when the anchor portion is pressed to the body. The head can be flattened to make the connection between the anchor portion and the body more secure.

22 Claims, 7 Drawing Sheets

DISPENSING CLOSURE WITH TAMPER EVIDENT LID PANEL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to tamper-evident systems for containers which must be altered in some fashion to obtain access to the container contents, the alteration being evidence that the container has been previously opened. The present invention is especially suited for a tamper-evident construction wherein a panel must be severed or separated to open the container.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence--even after the lid or spout has been subsequently closed. U.S. Pat. Nos. 4,487,324 and No. 4,941,592 disclose closures which incorporate a locking band or tab that is attached to either the lid or body of the closure with a plurality of frangible webs so as to initially retain the closure lid to the body in the closed position. To initially open the closure, the user must break the frangible webs by pushing or pulling on a tab or band.

U.S. Pat. No. 5,201,440 describes a container closure which includes a body for mounting on a container. The body defines a dispensing orifice. A lid is disposed on the body for being moved between open and closed positions relative to the dispensing orifice. A tamper-indicating member is provided as a unitary extension from the lid. A first frangible web connects the member to the lid. An anchor is connected with a second frangible web to another portion of the tamper-indicating member, and the anchor is retained by the closure body. The tamper-indicating member includes a graspable pull tab which can be pulled to completely sever the frangible webs connecting the tamper-indicating member to the lid and to the anchor. This permits the lid to be opened while providing evidence of tampering with the closure.

U.S. Pat. No. 5,875,907 discloses a closure for a container that has a body and a lid. The closure includes a tamper-indicating member connected to the body of the closure by an anchor member received in an anchor member-receiving aperture defined in the closure body. The tamper-indicating member is also connected along a frangible junction to the lid of the closure. A plug member extends from the tamper-indicating member and is receivable in a plug member-receiving aperture defined in the body. When the tamper-indicating member is depressed to force the plug member into the plug member-receiving aperture, the frangible junction is broken, and the tamper-indicating member is retained in its depressed position. This provides an indication that the closure may have been previously opened.

While the above-discussed closures can function well for the purposes for which they have been designed, it would be desirable to provide an improved tamper-evident closure which could be readily fabricated with certain types of lids or flow control elements and which, prior to the initial opening, could blend in with, or enhance, the cosmetic appearance of the closure. It would also be desirable for such a tamper-evident closure to be easily molded as one piece, including lid, body, and tamper-indicating portion, and to be easily deployed after molding to its tamper-indicating ready condition for eventual delivery to a user.

Further, it would be advantageous if such an improved closure could be initially opened relatively easily by the user. After such an improved closure has been initially opened and then closed, the closure should furnish a very clear indication that it has been previously opened. It would also be desirable to provide an improved tamper-evident closure design that includes a tamper-indicating member which, when altered during opening of the closure, would not result in the creation of a separate scrap piece that would require disposal.

The present invention provides an improved tamper-evident or tamper-indicating closure which can accommodate designs having the above-discussed benefits and features.

SUMMARY OF THE INVENTION

The present invention provides a tamper-indicating closure structure that includes a tamper-indicating member or tab which extends between a lid part and a body part of the closure structure, and includes a unique and novel system for fixing the tab to the body part. The tab includes an anchor portion for attachment to the body part, and a press portion connected by a frangible junction to either the anchor portion or the lid part and breakable at the frangible junction to free the lid part from the body part to open the closure structure.

In a preferred form of the invention, the anchor portion includes an aperture, and the body part includes a radially extending head. Pressing the anchor portion against the body part acts to snap fit the aperture over the head to at least temporarily hold the tab to the body part. If necessary, the head can then be flattened or otherwise deformed to make the connection more permanent.

In one embodiment of the present invention, the tab of the tamper-indicating closure structure includes an anchor portion for attachment to the body part, and a press portion which is connected by a frangible junction to the anchor portion and which is connected by a hinge to the lid part. The frangible junction is breakable to free the lid part from the body part to open the closure structure.

The present invention provides a novel tamper-indicating dispensing structure which blends well with, and/or enhances, the cosmetic appearance of a container or a closure and yet can be easily manipulated by the user to permit the structure to be opened for dispensing. The structure of the invention gives a clear indication of an initial opening of the structure. The structure, if embodied as a closure, can be configured to be easily molded as a single piece which can be mounted on a container in a tamper-indicating ready condition, i.e., ready to be first opened by a user.

The features of the invention can be adapted for use in a variety of dispensing container or closure designs. In one illustrated embodiment, the features can be incorporated in a closure having a body suitable for mounting as a separate piece on a container. Alternatively, the body could be formed as a unitary part of, or extension of, the container.

In a preferred embodiment, a dispensing closure structure includes a body defining a dispensing orifice, and a lid for closing the dispensing orifice. In such a preferred embodiment, the body is adapted to be mounted on the container. The lid may be hinged to the body or may be a separate piece otherwise adapted to engage the body.

The tamper-indicating member includes a press portion that is connected to one of the lid or the body via a hinge. The press portion is also connected to the other one of the lid or the body via a frangible junction. The hinge allows deflection of the press portion of a magnitude sufficient to break the frangible junction. In the preferred form of the invention, the press portion is hinged to the lid and anchored to the body.

The press portion can be retained in the inwardly displaced orientation as a further indication that the frangible junction has been broken. The retention of the press portion in the inwardly displaced position can also provide a space below an overhanging part of the lid to accommodate a person's finger for lifting the lid away from the body.

In the preferred form of the invention, the connection of the tamper-indicating member to the body is effected at least by an aperture through the anchor portion for receiving an anchor member which extends from the body. The anchor portion can be pushed inwardly in a region adjacent the anchor member so as to force the anchor member into the aperture of the anchor portion. If required, the anchor member can be subsequently deformed to more securely fix the anchor portion to the body.

The dispensing structure, including body, lid, and tamper-indicating member, can be molded as a unitary, separate closure which is snap-engaged into the tamper-indicating ready condition. The closure can be cost effectively manufactured and installed on a container.

Numerous other advantages or features of the present invention will become readily apparent from the following detailed description of the invention, from the claims, and from the accompanying drawings.

DETAILED DESCRIPTION OF THE PREFERRED EMBODIMENTS

Figures 1, 2:
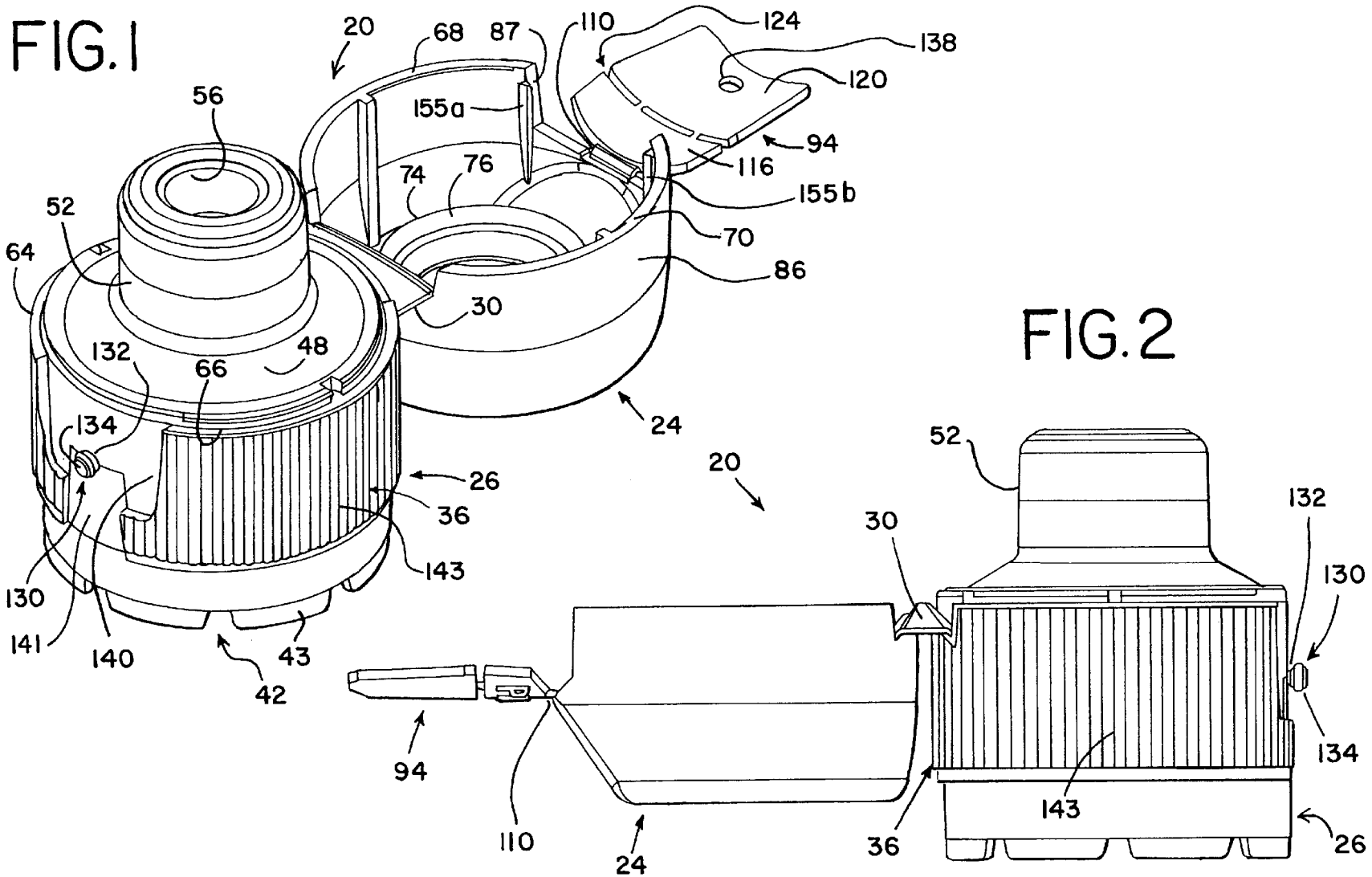
FIG. 1 is a perspective view of a first embodiment of an unassembled closure of the present invention shown in the as-molded, open condition.
FIG. 2 is a side view of the closure of FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, the dispensing structure of this invention is described in various operating positions. It will be understood, however, that the dispensing structure of this invention may be manufactured, stored, transported, used, and sold in orientations other than the positions described.

FIGS. 1 through 9 illustrate one presently preferred embodiment of the dispensing structure of the invention, in the form of a dispensing closure designated generally by the reference number 20. The dispensing structure or closure 20 is provided as a separately manufactured unit for mounting to the top of a container 22, such as to a container neck 22*a* (shown partially in FIG. 6). It will be appreciated, however, that it is contemplated that in some applications it may be desirable for the dispensing structure 20 to be formed as a unitary part, or extension, of the container 22.

In the embodiment illustrated, the closure 20 is molded as a unitary structure from a thermoplastic material, such as polyethylene or polypropylene. Typically, the closure 20 is molded in the open condition as illustrated in FIGS. 1 and 2.

As illustrated in FIGS. 1 and 2, the dispensing structure or closure 20 includes a lid 24 and a body 26. The lid 24 is connected by a hinge 30 to the body 26. Preferably, the hinge 30 is a snap-action hinge formed integrally with the lid 24 and body 26, in a molded unitary structure. The illustrated snap-action hinge 30 is a conventional type as described in U.S. Pat. No. 5,642,824. The snap-action hinge readily maintains the lid 24 in the open position during the dispensing of the container contents at the application site. Alternatively, the lid 24 can be tethered to, or completely removable from, the closure body 26.

Figure 6:
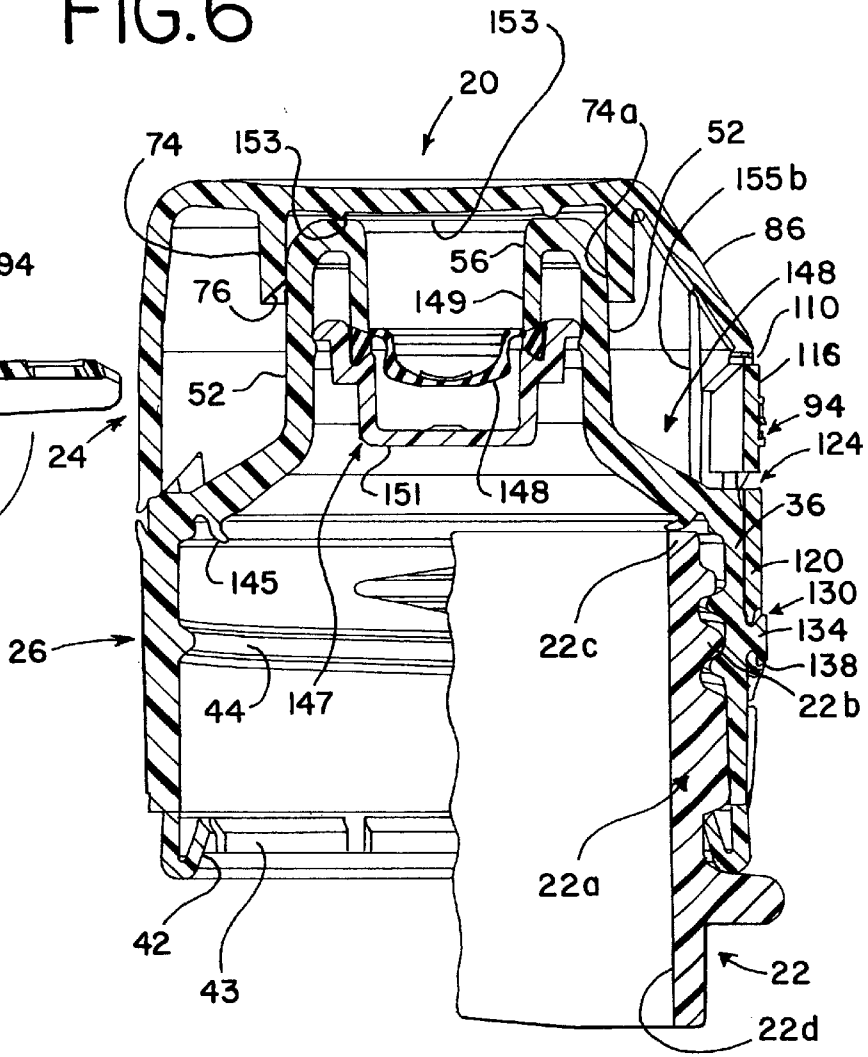
FIG. 6 is a fragmentary cross-sectional view of the closure of FIG. 5 in a fully assembled state or final assembly configuration mounted on a container neck.

The closure body 26 includes a skirt 36 which defines a lower opening 42 for receiving a container neck 22*a* of a container 22 (as illustrated in FIG. 6). The skirt 36 is adapted to surround and engage the container neck 22*a* of the container 22. The skirt 36 can include conventional threads 44 which engage conventional threads 22*b* on the container to secure the closure body 26 to the neck 22*a* of the container 22.

A conventional closure-to-container tamper-indicating band 43 is formed around the opening 42. In FIGS. 1, 2, 4, 5, 10, 11, 12 and 13 the tamper-indicating band 43 is illustrated in a preliminary condition before being properly formed to engage a container. In FIGS. 6, 7, 8 and 9 the tamper-indicating band 43 is shown completely formed. In FIG. 6 the tamper-indicating band 43 is shown completely formed and engaged to the container neck 22*a*.

A deck 48 (FIG. 1) extends radially inwardly from the upper end of the skirt 36. The deck 48 includes an upwardly extending cylindrical wall or nozzle 52 defining a dispensing orifice 56. Outwardly of the deck 48, the upper end of the skirt 36 defines lateral shoulders or side ledges 64, 66.

Figure 5:
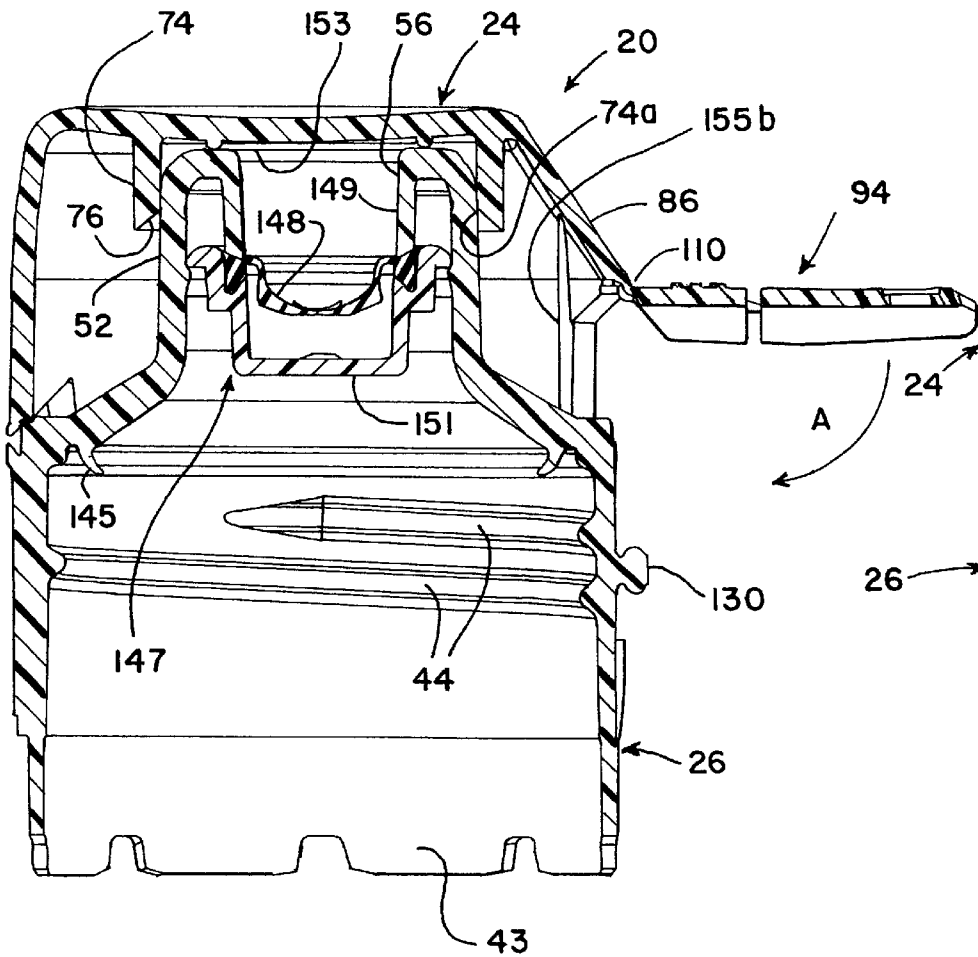
FIG. 5 is a cross-sectional view of the closure of FIG. 4.

The lid 24 includes bottom surface portions 68, 70 which abut the side ledges 64, 66 when the lid 24 is closed to the body 26. The lid 24 also includes a locating ring 74 with a beveled edge 76 which is sized to slide down around the cylindrical wall or spout 52 (as shown in FIGS. 5 and 6). The ring 74 includes a radial seal bead 74*a* which seals against an outside surface of the spout 52. The lid 24 further includes a support ring 153 on an inside surface thereof (FIGS. 5 and 6). The support ring 153 supports the lid to withstand the downward forces generated in the forming of the tamper-indicating band 43.

The lid 24 has an outer peripheral wall 86. The wall includes a substantially rectangular recess 87 on a front side thereof ("front side" when the lid is in a tamper-indicating ready condition as shown in FIG. 6). A tab or tamper-indicating member 94 extends from a top edge of recess 87 ("top edge" when the lid is in a tamper-indicating ready condition as shown in FIG. 6). The tamper-indicating member 94 is connected to the lid 24 at the top edge by a film hinge 110, and includes a press portion 116 and an anchor portion 120.

Figure 8:
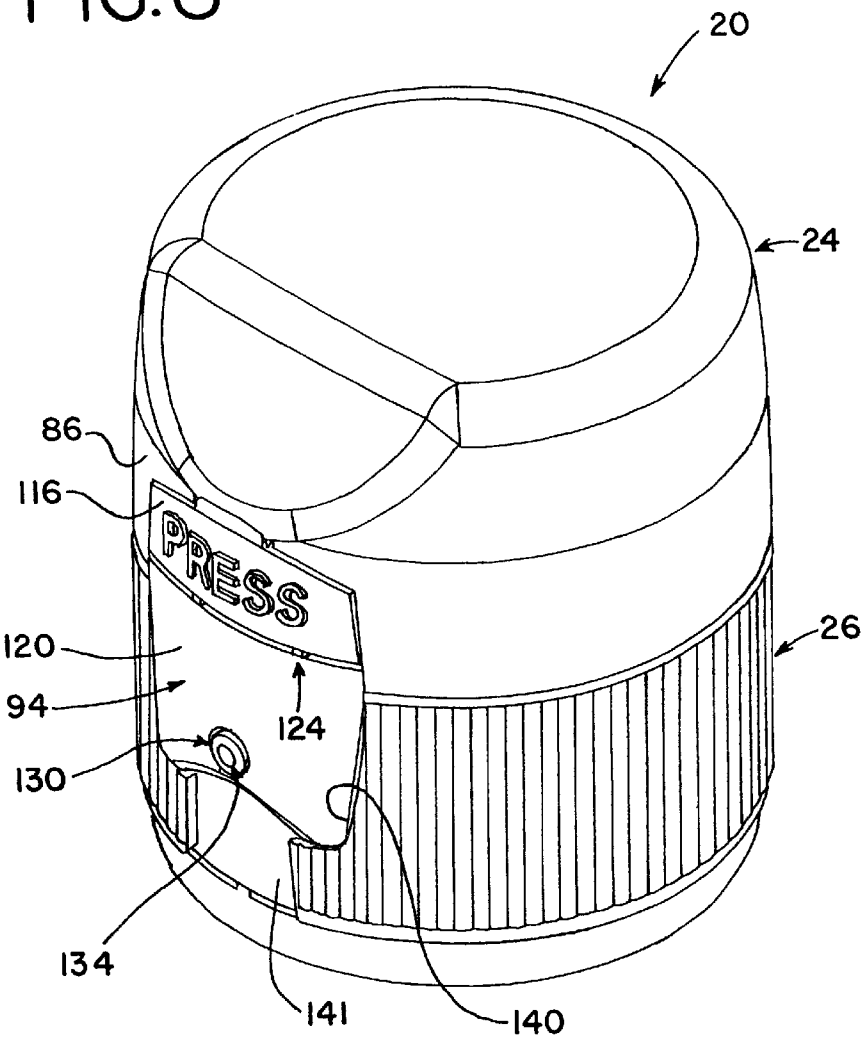
FIG. 8 is a perspective view of the closure in a closed and final assembly configuration corresponding to the configuration shown in FIG. 6.

The tamper-indicating member 94 is preferably curved to match the outside contours of the body 26 and lid 24 (as shown in FIG. 8). The hinge 110 is preferably molded with the closure 20 as a reduced thickness section of material.

A wall recess 140 extends into the skirt 36 on a front side thereof. The recess 140 is sized to receive the anchor portion 120 of the tamper-indicating member 94 when the anchor portion 120 is pivoted into its tamper-indicating ready position. The recess is preferably sized and shaped to receive the anchor portion 120 in a close fitting or tight clearance manner. This permits the member 94 and the skirt 36 to have substantially flush outer surfaces (FIGS. 6 and 8). A second, adjoining recess 141 allows for molding of the closure with an anchor member 130 (described in detail hereinafter) in a mold without side action mold parts. A raised, ribbed surface 143 extends around the body skirt 36 to the recesses 140, 141 for providing a gripping surface.

Figure 3:
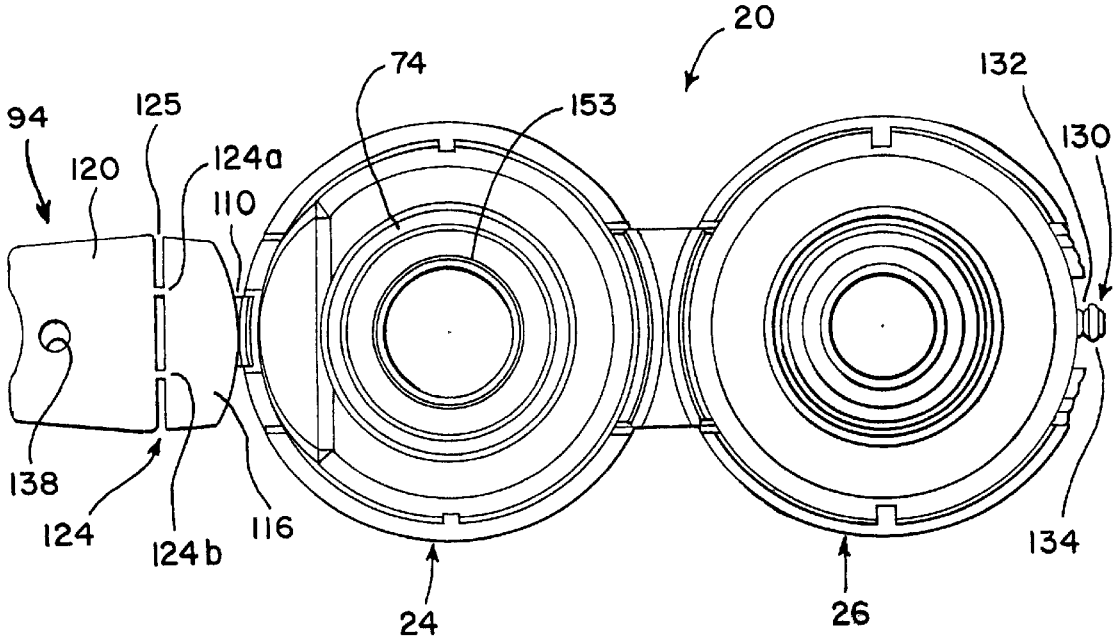
FIG. 3 is a top plan view of the closure of FIG. 1.

As shown in FIG. 3, the press portion 116 and anchor portion 120 are connected by a frangible junction 124. The frangible junction 124 could be molded with closure 20 as a reduced thickness section of material defined by an interior notch or groove. The frangible junction 124 could also be an intentionally weakened junction created by partially cutting through a thickness of the frangible junction 124 with perforations, scoring, indentations, or created by materials selection, tapering, or other means to define an easily breakable junction between the press portion 116 and the anchor portion 120. According to the preferred embodiment, the frangible junction includes a substantially linear gap 125 bridged by two webs or bridges 124*a*, 124*b* as illustrated in FIG. 3. The bridges are relatively easily breakable by force exerted on the frangible junction.

Extending from the skirt 36 is the anchor member 130. The anchor member 130 has a neck 132 which terminates at a rounded cylindrical head 134 (illustrated most clearly in FIGS. 1 and 4). The anchor member 130 extends from a central area of the recess 140.

The anchor portion 120 of the tamper-indicating member 94 includes an anchor member-receiving aperture 138. The aperture 138 has a diameter slightly smaller than the diameter of the head 134.

Figure 4:
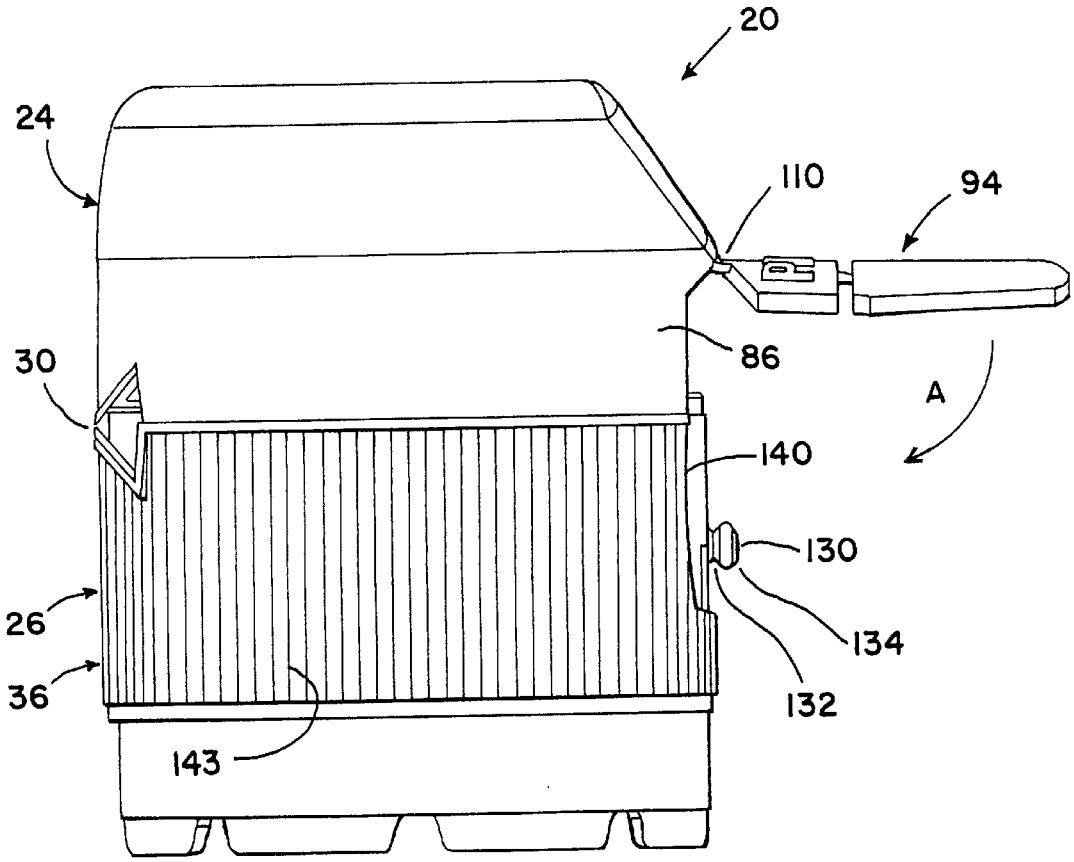
FIG. 4 is a side view of the closure of FIG. 1 in a partially assembled state or configuration with the lid closed.

During assembly, the lid 24 is initially closed onto the body 26 by being rotated about 180° to the position shown in FIGS. 4 and 5. In this position of the lid 24, the member 94 is still in its initial, or first, as-molded position extending outwardly from the front of the lid peripheral wall 86. The tamper-indicating member 94 is subsequently forcibly rotated about the hinge 110 downwardly about 90° in the direction A (indicated by the arrow in FIGS. 4 and 5) and then snap-engaged to the anchor member 130. The anchor member-receiving aperture 138 of the anchor portion 120 captures the anchor member 130 as shown in FIGS. 6 and 8.

When the tamper-indicating member 94 is rotated and pressed into a tamper-indicating ready position, the head 134 is sized to be pushed through the aperture 138 owing to the resilient deformation of the head and/or resilient stretching of the anchor portion 120 around the aperture 138. Thus, the contoured surface of the head 134 can temporarily stretch the aperture 138 to an increased diameter, and/or the head can be temporarily deformed, so as to accommodate insertion of the head. The aperture 138 and/or the head 134 return to their original, undeformed shapes once the head has passed through the anchor portion 120 to a front side of the aperture 138 so as to retain the anchor portion 120, in snap fit fashion, on the anchor member 130. The aperture 138 then circumscribes the neck 132.

FIG. 6 illustrates the closure 20 after the member 94 has been pivoted downwardly and anchored to the body skirt 36. The closure 20 is in a tamper-indicating ready condition wherein it is ready to be first opened by a user. The head 134, after having been received in snap fit fashion into the aperture 138, has been peened or flattened such that the anchor portion 120 cannot be pulled outwardly from the head 134 without breaking or tearing either the head 134 or the skirt 36. The anchor member 130 fixes the anchor portion 120 of the member 94 to the body 26 at a location which is below, but adjacent to, a pressing space 148. The pressing space 148 is generally defined within the lid 24, between the spout 52 and the press portion 116. The press portion 116 of the member 94 defines an unsupported span over the pressing space 148 from the frangible junction 124 to the hinge 110.

As shown in FIGS. 5 and 6, the spout 52 can carry a flow control assembly 147 which regulates flow between the container interior and exterior through the orifice 56. The assembly 147 can include a flexible valve member 148 captured between an internal collar 149 of the spout 52 and a snap-in valve retainer 151. An annular, flexible "crabs claw" shaped seal 145 projects from the lower surface of the closure body deck 48 to seal against a top surface of the container neck 22*a* so as to provide a leak-tight seal between the closure body 26 and the container neck 22*a*. Of course, other types of closure body container seals may be employed.

The threads 44 of the skirt 36 engage threads 22*b* of the container neck 22*a* to releasably attach the closure 20 on the container 22. The closure body 26 could also be releasably attached to the container 22 with a snap-fit bead and groove, or by other means. Alternatively, the closure body 26 may be permanently attached to the container by means of a suitable snap-fit, or by means of induction melting, ultrasonic melting, glueing, or the like, depending upon the materials employed for the container and closure. Further, the closure 20 could, in some applications, be formed as a unitary part, or extension, of the container 22.

The container 22 (FIG. 6) typically has a conventional mouth or opening 22*c* which provides access to the container interior and product contained therein. The product may be, for example, a liquid comestible product. The product could also be any other solid, liquid, or gaseous substance, including, but not limited to, a food product, a personal care product, and industrial or household product cleaning product, a paint product, a wall patch product, or other chemical composition (e.g., for use in activities involving manufacturing, commercial or household maintenance, construction, remodeling, and agriculture), etc.

In the illustrated embodiment (FIG. 6), the container neck 22*a* extends from a hollow body 22*d* and defines the container mouth or opening 22*c*. The container neck 22*a* may have (but need not have) a circular cross-sectional configuration, and the body 22*d* of the container 22 may have another cross-sectional configuration, such as an oval cross-sectional shape, for example. The container 22 may, on the other hand, have a substantially uniform shape along its entire length or height without any neck portion of reduced size or different cross-section.

The container 22 may be a squeezable container having a flexible wall or walls which can be grasped by the user and compressed to increase the internal pressure within the container so as to squeeze the product out of the container through the closure 20 when the closure 20 is open. Such a container will typically have sufficient, inherent resiliency so that when the squeezing forces are removed, the container wall returns to its normal, unstressed shape. Such a structure is preferred in many applications, but may not be necessary or preferred in other applications that are substantially rigid. A piston could be provided in such a rigid container to aid in dispensing a product, especially a relatively viscus product.

Figure 7:
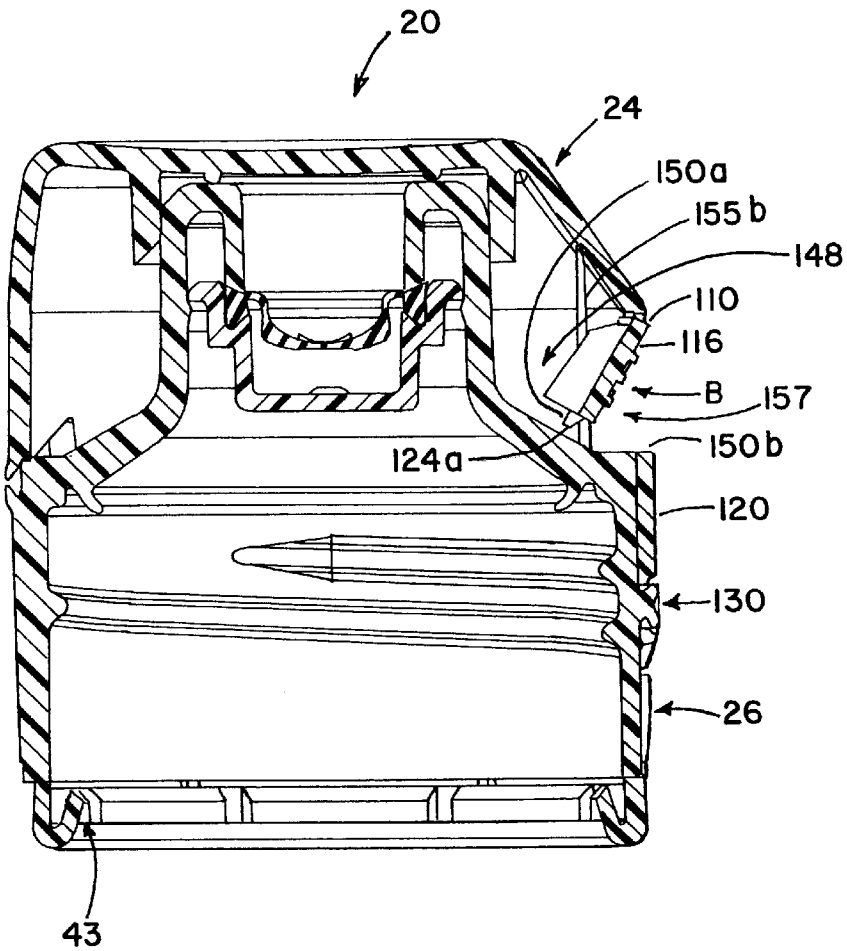
FIG. 7 is a cross-sectional view of the closure of FIG. 6 after a tamper-indicating portion has been manipulated to permit a lid of the closure to be opened.

As illustrated in FIG. 7, when the closure 20 is to be opened for the first time, the press portion 116 is forcibly depressed inwardly in the direction B. The press portion 116 bends about the hinge 110 and the frangible junction 124 is thereby broken and separated into free edges 150*a* and 150*b*. The press portion deflects into the pressing space 148. Preferably, the bridges 124*a*, 124*b* are broken off at the lower edge 150*b* and carried with the press portion 116, to leave a relatively smooth surface on the edge 150*b*. One exemplary application of the closure is for use on a drinking bottle. A smooth edge 150*b* is preferred for user comfort when placing a user's lips around the spout 52.

The press portion 116 is held in the retracted position shown in FIG. 7 by ribs 155*a*, 155*b* (shown in FIG. 1). The press portion 116 is forced tightly between the ribs 155*a*, 155*b* and held therebetween by friction.

The lid 24 can be pried open from the body 26 by pushing upwardly with a finger against the deflected press portion 116, the finger placed in an external space 157 created by the inward movement of the press portion 116 into the pressing space 148. The external space 157 is defined by the recess 87 (FIG. 1) in the sidewall 86 and the press portion 116.

FIG. 8 illustrates the closure 20 in fully assembled condition. The anchor portion 120 is curved and fits with tight clearance into the recess 140. The head 134 of the anchor member 130 has been flattened by peening to be substantially flush with the anchor portion 120.

Figure 9:
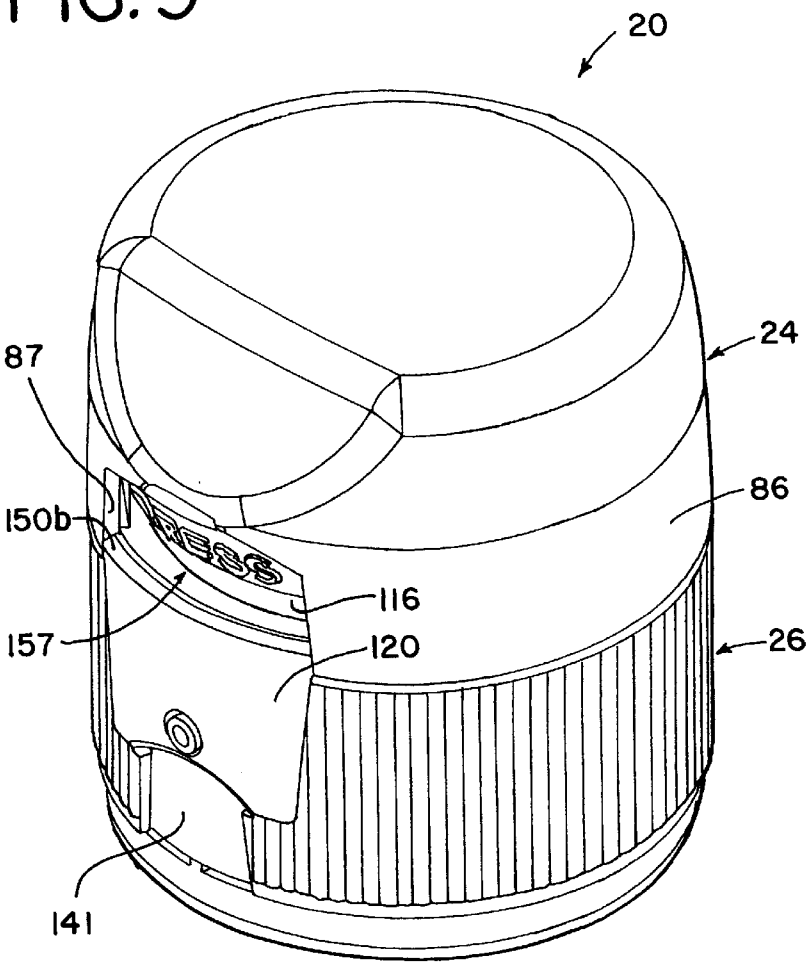
FIG. 9 is a perspective view of the closure of FIG. 8 after the tamper-indicating element is broken.

FIG. 9 illustrates the closure 20 just after the press portion 116 has been deflected inwardly to break the frangible junction 124 (FIG. 1). The recess 87 in the lid sidewall 86 (FIG. 9) and the press portion 116 define the external space 157, useful for receiving a user's finger to pry open the lid 24 from the body 26.

FIG. 10–13 illustrate an alternate embodiment of a closure 20' which is substantially identical to the closure 20 except for reconfigured structure associated with an alternate tamper-indicating member 94'. Identical elements carry identical reference numbers.

Figure 10:
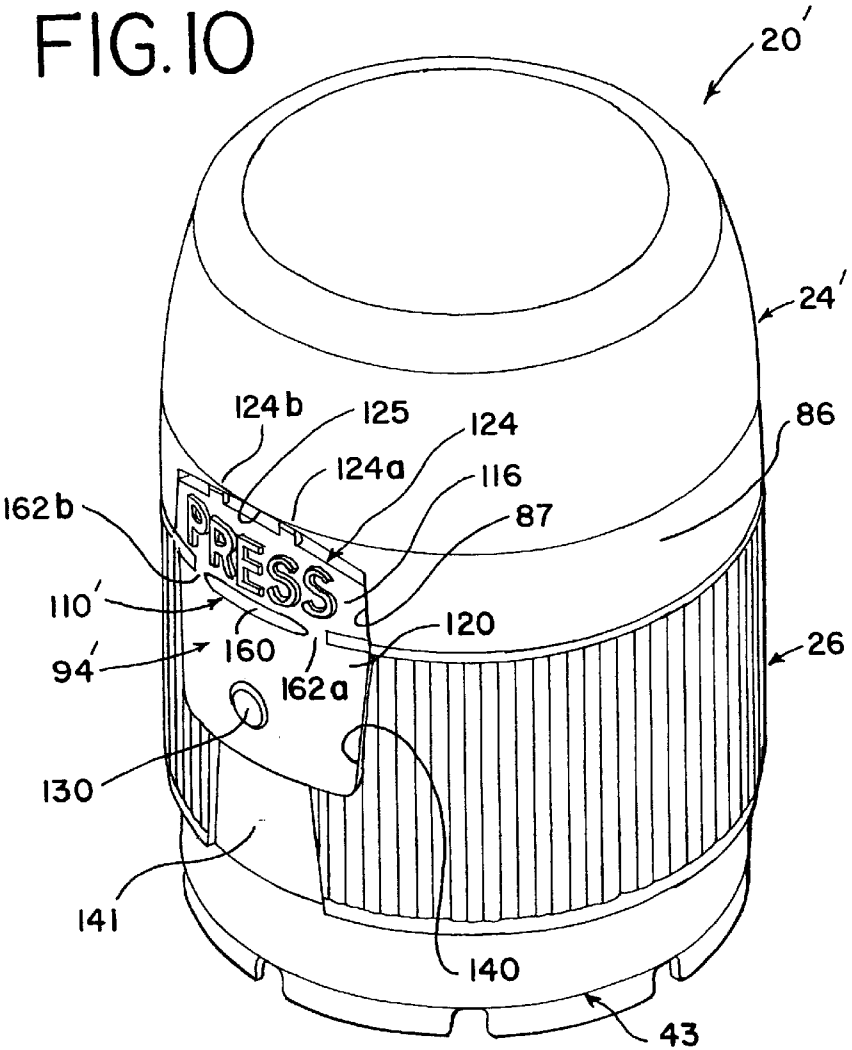
FIG. 10 is a perspective view of a alternate embodiment closure in a fully assembled state.
Figure 12:
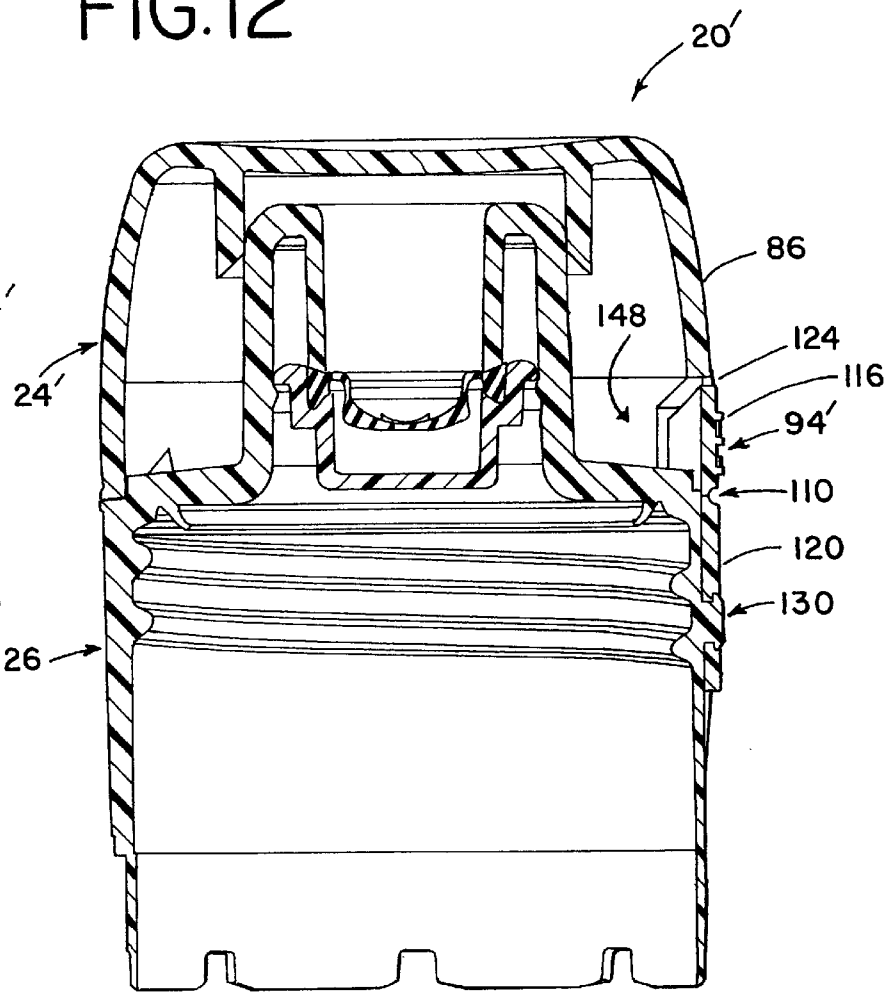
FIG. 12 is a cross-sectional view of the closure of FIG. 10 in the final assembly configuration.
Figure 11:
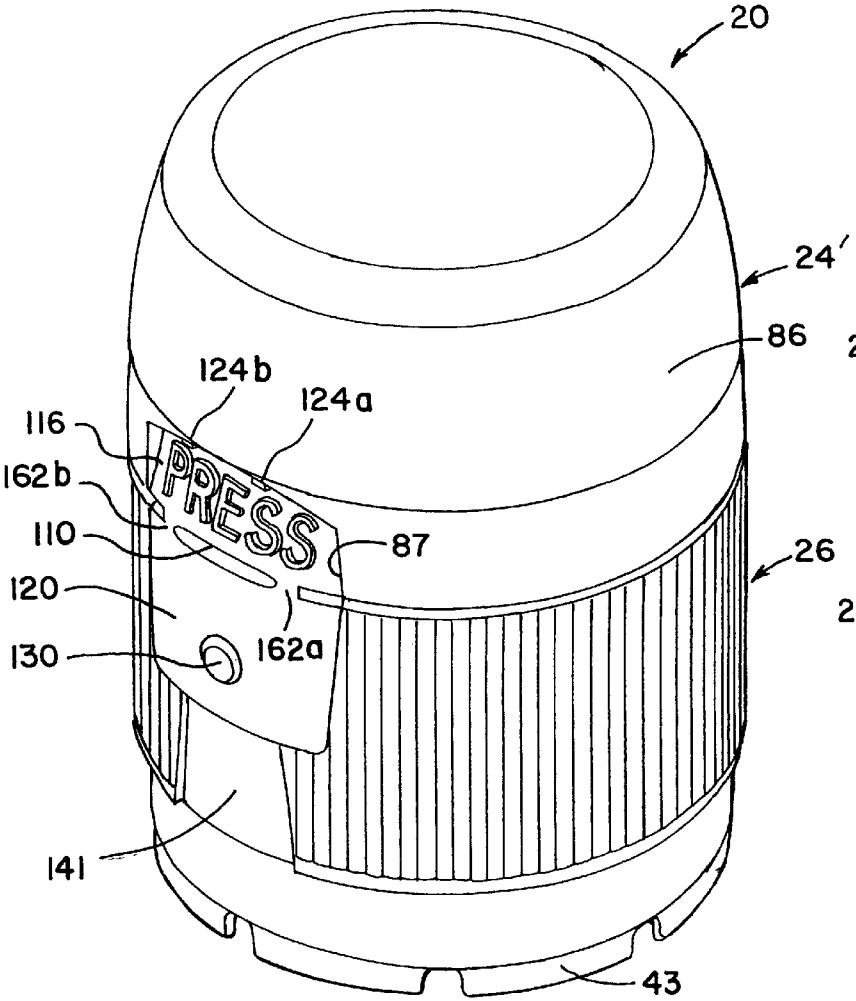
FIG. 11 is a perspective view of the closure of FIG. 10 after a tamper-indicating element is broken.
Figure 13:
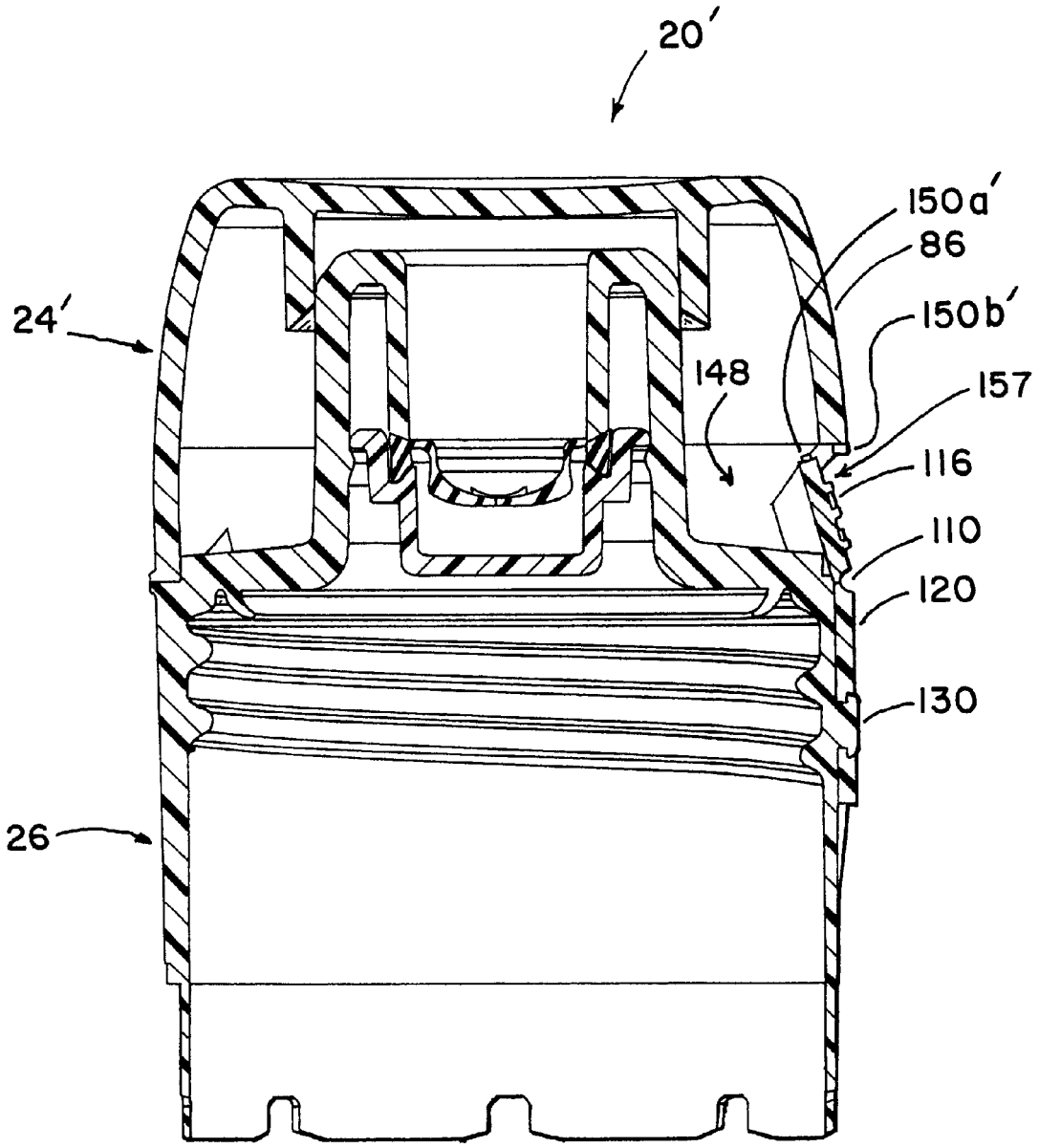
FIG. 13 is a cross-sectional view of the closure of FIG. 12 after a tamper-indicating portion has been manipulated to permit a lid of the closure to be opened.

FIGS. 10 and 12 illustrate the modified closure 20' in a fully assembled condition. FIGS. 11 and 13 illustrate the closure 20' of FIG. 10 after the tamper-indicating member 94' has been actuated to allow an alternate lid 24' to be lifted from the body 26 to an open position.

The member 94' includes the same press portion 116 and the anchor portion 120 as previously described. An alternate hinge 110' however, is relocated to connect the press portion 116 to the anchor portion 120. The alternate hinge 110' can be a weakened junction which promotes bending. The illustrated junction is formed by a substantially linear through-slot 160 crossed by two bendable bridges 162*a*, 162*b*. The frangible junction 124 connects the press portion 116 to the lid wall 86. The frangible junction 124 preferably is formed by the gap 125 (FIG. 10) and the two bridges 124*a*, 124*b* as previously described with reference to the first embodiment illustrated in FIGS. 1–9. Sufficient inward force on the press portion 116 will pivot the press portion about the hinge 110' to break the frangible junction 124.

In this embodiment, as illustrated in FIGS. 12 and 13, the frangible junction 124 is broken to separate the lid 24' from the tamper indicating member 94'. Both the press portion 116 and the anchor portion 120 remain with the body 26 when the lid 24' is lifted to an open position (not illustrated).

Breaking the frangible junction 124 creates free edges 150*a*', 150*b*' between the press portion 116 and the lid 24', respectively. Preferably, the bridges 124*a*, 124*b* break off to remain with the lid 24', so that the edge 150*a*' (FIG. 13) is substantially smooth. One exemplary application of the closure is for use on a drinking bottle. A smooth edge 150*a*' is preferred for user comfort when placing a user's lips around the spout 52. A structure, such as the ribs 155*a*, 155*b* described above with reference to the first embodiment illustrated in FIGS. 1–9, but relocated onto the body 26, or as described in U.S. Pat. No. 5,875,907, can be provided to hold the press portion 116 in its retracted position shown in FIG. 13.

Although a single anchor member 130 is depicted in the embodiments, it is within the scope of the invention to provide multiple anchor members which may, for example, each be identical with the anchor member 130. The anchor portion 120 would then have a plurality of corresponding anchor member-receiving apertures. Multiple anchor members may provide a more secure attachment of the anchor portion 120 to the skirt 36.

Alternatively, the above-described single or multiple anchor members 130 may be replaced by one or more laterally extending wall-like members wherein each wall-like member has an enlarged distal end in the form of a continuous head with an enlarged cross-section. Such wall-like members could each have a transverse cross section corresponding to the transverse cross section of the anchor member 130 as shown in FIG. 2, but each wall-like member would be laterally elongated in a direction into and out of the plane of FIG. 2. The anchor portion 120 would define elongated slots for receiving the enlarged end portions of the wall-like members which function as the anchor members.

As can be understood from the above description of the various embodiments, the invention provides a tamper-indicating structure which advantageously retains the tamper-indicating member 94, 94' in a unique configuration on the structure without creating a separately disposable scrap piece. The body 26, lid 24, 24', and tamper-indicating member 94, 94' can be advantageously molded from thermoplastic material as a unitary structure. The hinge 110, 110' and the frangible junction 124 can be created by the molding process, or after molding by other processes.

The invention could also employ other modes of movement of the tamper-indicating member 94, 94', such as sliding or twisting, in order to break the frangible junction 124.

It will be readily observed from the foregoing detailed description of the invention and from the illustrations thereof that numerous other variations and modifications may be effected without departing from the true spirit and scope of the novel concepts or the principles of this invention.

What is claimed is:

1. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion connected by a hinge to said lid, and an anchor portion connected to said body, said press portion connected at a frangible junction to said anchor portion, whereby said press portion can be moved sufficiently about said hinge by pressing radially inwardly on said press portion, relative to said anchor portion, to separate said press portion from said anchor portion while said press portion remains attached to said anchor portion to prevent creation of a separate scrap piece.

2. The closure structure according to claim 1, wherein said press portion extends effectively unsupported on a back side thereof, from said hinge to said frangible junction.

3. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion connected by a hinge to said lid, and an anchor portion connected to said body, said press portion connected at a frangible junction to said anchor portion, whereby said press portion can be moved sufficiently about said hinge, relative to said anchor portion, to separate said press portion from said anchor portion, said body including a recess adjacent said press portion, said press portion being deflectable into said recess when said frangible junction is broken.

4. The closure structure according to claim 3, wherein said body includes an anchor member projecting from said body;

said anchor portion includes an aperture which registers with said anchor member; and said anchor member is sized and shaped to be resiliently received in said aperture and held by said anchor portion.

5. The closure structure according to claim 1, wherein said body includes an anchor member projecting from said body;

said anchor portion includes an aperture which registers with said anchor member; and said anchor member is sized and shaped to be resiliently received in said aperture and held by said anchor portion.

6. The closure structure according to claim 1, wherein said press portion is separatable from said anchor portion along said frangible junction when said press portion is displaced toward said body, whereby after said press portion has been separated from said anchor portion and displaced toward said body, a finger-engageable overhang is then defined by said press portion with respect to said body.

7. The closure structure according to claim 1, wherein said body defines an anchor member; and said anchor portion defines an anchor member-receiving aperture for receiving said anchor member to fasten said tamper-indicating member to said body.

8. The closure structure according to claim 1, wherein said closure structure is formed as a unitary part of said container.

9. The closure structure according to claim 1, wherein said closure structure is formed as a separate piece to be attached to a container.

10. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion connected by a hinge to said lid, and an anchor portion connected to said body, said press portion connected at a frangible junction to said anchor portion, whereby said press portion can be moved sufficiently about said hinge, relative to said anchor portion, to separate said press portion from said anchor portion, said frangible junction comprising a gap separating said press portion and said anchor portion, and a plurality of bridge members spanning said gap and extending between said press portion and said anchor portion.

11. The closure structure according to claim 1, wherein said closure structure includes (1) a neck radially extending from said body, (2) a head extending from an end of said neck, and (3) an aperture that is formed through said anchor portion sized to snap fit over said head to be captured by said head around said neck to define a fastening arrangement connecting said anchor portion to said body.

12. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion connected by a hinge to said lid, and an anchor portion connected to said body, said press portion connected at a frangible junction to said anchor portion, whereby said press portion can be moved sufficiently about said hinge, relative to said anchor portion to separate said press portion from said anchor portion, said lid including rib members arranged adjacent to said press portion, said rib members being spaced apart to frictionally engage said press portion when said press portion has moved sufficiently to separate from said anchor portion whereby said rib members hold said press portion separated from said anchor portion.

13. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion connected by a hinge to said lid, and an anchor portion connected to said body, said press portion connected at a frangible junction to said anchor portion, whereby said press portion can be moved sufficiently about said hinge, relative to said anchor portion to separate said press portion from said anchor portion, said lid including a sealing structure arranged to close said dispensing orifice, said sealing structure being surrounded by a sidewall, said sidewall having a sidewall recess, said press portion being connected by said hinge within said sidewall recess, and said body including a deck having a spout extending therefrom and defining said dispensing orifice, said sidewall being adapted to abut said deck, said press portion being arranged to be displaced into a space between said spout and said sidewall recess when said press portion is separated from said anchor portion.

14. The closure according to claim 13, wherein said sidewall recess and said press portion have substantially coextensive areas.

15. The closure according to claim 14, wherein said lid comprises ribs located on opposite sides of said recess and having an inward extension such that when said press portion moves to be separated from said anchor portion, said ribs frictionally engage said press portion to hold said press portion in a deflected position.

16. The closure according to claim 1, wherein said containing wall comprises a wall recess sized to receive said anchor portion, and when said anchor portion is received into said wall recess, said anchor portion and adjacent regions of said containing wall are substantially flush.

17. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member including a press portion and an anchor portion, said anchor portion defining an aperture therethrough, said body including a head extending radially therefrom, said aperture sized to snap fit over said head to hold said anchor portion to said body, and said press portion is frangibly connected to one of said lid and said anchor portion, and hingedly connected to a respective other of said lid and said anchor portion to connect said lid to said body through said tamper-indicating member, whereby radially pressing said press portion causes said frangible junction to rupture to disconnect said lid from said body at said tamper-indicating member.

18. The closure structure according to claim 17, wherein said frangible junction is located between said press portion and said anchor portion, and said hinge is located between said press portion and said lid.

19. The closure structure according to claim 17, wherein said frangible junction is located between said press portion and said lid, and said hinge is located between said anchor portion and said press portion.

20. The closure structure according to claim 17, wherein said body is formed as a unitary part with a container.

21. The closure structure according to claim 17, wherein said body is formed separately from a container, said body including threads for mounting said closure to a neck of said container.

22. The closure structure according to claim 17, wherein said body is formed separately from a container, said body including attaching means for attaching said closure to a container.

* * * * *